US010975521B2

(12) United States Patent
Seymour et al.

(10) Patent No.: US 10,975,521 B2
(45) Date of Patent: Apr. 13, 2021

(54) FIBROUS WEB DEWATERING APPARATUS AND METHOD

(71) Applicant: Kimberly-Clark Worldwide, Inc., Neenah, WI (US)

(72) Inventors: Robert James Seymour, Appleton, WI (US); Mark John Hassman, Oshkosh, WI (US); Craig Steven Besaw, Stevens Point, WI (US); Reza Ramazani-Rend, Appleton, WI (US); Jason Michael Rudolph, Kimberly, WI (US); Thomas McLachlan Jenn, Appleton, WI (US); Lucia Yiyi Chai, Naperville, IL (US); Samuel August Nelson, Menasha, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 217 days.

(21) Appl. No.: 16/068,757

(22) PCT Filed: Jan. 24, 2017

(86) PCT No.: PCT/US2017/014693
§ 371 (c)(1),
(2) Date: Jul. 9, 2018

(87) PCT Pub. No.: WO2017/132123
PCT Pub. Date: Aug. 3, 2017

(65) Prior Publication Data

US 2019/0024311 A1 Jan. 24, 2019

Related U.S. Application Data

(60) Provisional application No. 62/288,108, filed on Jan. 28, 2016.

(51) Int. Cl.
*D21F 7/00* (2006.01)
*D21F 1/52* (2006.01)

(52) U.S. Cl.
CPC ..... *D21F 7/008* (2013.01); *D21F 1/52* (2013.01)

(58) Field of Classification Search
CPC ... D21F 1/48; D21F 1/52; D21F 1/523; D21F 1/526; D21F 3/10; D21F 3/105;
(Continued)

(56) References Cited

U.S. PATENT DOCUMENTS 3,945,570 A 3/1976 Dove
4,268,976 A * 5/1981 Dove ..... D21F 7/008 162/290
(Continued)

FOREIGN PATENT DOCUMENTS

CN 204059091 U 12/2014
DE 102011086617 A1 5/2013
(Continued)

*Primary Examiner* — Eric Hug
(74) *Attorney, Agent, or Firm* — Kimberly-Clark Worldwide, Inc.

(57) ABSTRACT

The present disclosure relates to a vacuum dewatering apparatus comprising a vacuum box disposed opposite of a steam box where the steam box comprises a bottom plate having a substantially linear portion and a curvilinear portion. A plurality of apertures are disposed along at least a portion of the curvilinear portion to permit the transmission of steam. In a preferred embodiment, the curvilinear portion is adjacent to the trailing edge and the linear portion is adjacent to the leading edge of the apertured bottom plate. Further, at least a portion of the apertures are aligned opposite the vacuum box which acts to remove the steam. The vacuum dewatering apparatus of the present invention
(Continued)

enables the use of high levels of steam improving vacuum dewatering and improving drying efficiency.

16 Claims, 2 Drawing Sheets

(58) Field of Classification Search
CPC . D21F 5/042; D21F 5/14; D21F 5/143; D21F 7/008
See application file for complete search history.

(56) References Cited

U.S. PATENT DOCUMENTS 4,331,510 A * 5/1982 Wells ..... D21F 7/008 162/252
4,398,355 A 8/1983 Dove
5,149,401 A * 9/1992 Langevin ..... D21F 7/003 162/207
5,689,897 A 11/1997 Schiel
5,752,324 A 5/1998 Muller
6,200,425 B1 3/2001 Pellinen
6,264,795 B1 7/2001 Hamel
6,408,534 B1 * 6/2002 Alen ..... D21F 7/008 34/114
6,460,775 B1 10/2002 Duan
6,944,966 B2 9/2005 Winheim
7,503,129 B2 3/2009 Mann
7,634,860 B2 12/2009 Hamel
7,694,433 B2 * 4/2010 Fisher ..... B31F 1/07 34/446
9,145,644 B2 9/2015 Crawford
2014/0310978 A1 10/2014 Crawford

FOREIGN PATENT DOCUMENTS

WO WO06132977 A2 12/2006
WO WO13072560 A1 5/2013

* cited by examiner

FIBROUS WEB DEWATERING APPARATUS AND METHOD

BACKGROUND OF THE DISCLOSURE

Steam boxes are commonly used in the manufacture of paper products to improve dewatering of fibrous webs at various locations on the paper machine. Steam boxes may be used to improve dewatering by impinging steam onto the fibrous web as it is conveyed through the papermaking process while simultaneously subjecting the web to a vacuum. The increase in temperature caused by the steam reduces the viscosity and surface tension of the water within the web, resulting in more efficient removal by the vacuum.

To facilitate removal of water from the fibrous web the steam box may be installed in the wire section of the paper machine after formation of the fibrous web, in which case the steam box may be used to increase the temperature of the fibrous web to drain the warmed water more easily and thus increase the dry content and improve the drying capacity of the dryer section. By means of steam boxes it is, for instance, possible to increase the capacity of the paper machine.

The use of a conventional steam box with a vacuum dewatering system to improve paper machine capacity however, has its limitations. For example, when the steam flow to individual compartments of a compartmental steam box is reduced below the fixed local volumetric rate of the vacuum system the system will make up flow from adjacent compartments or air outside the hood. The result is reduced moisture uniformity across the fibrous web and a reduced control of dewatering. Another disadvantage of conventional steam boxes is that the amount of steam condensed in the web is largely dependent upon the porosity of the sheet and the capacity of vacuum available. If the steam flow is increased to a point where either of these limitations is exceeded, excess steam will blow out into the machine room. This problem becomes evident when the known compartmented hoods attempt to cope with wet streaks.

Thus there remains a need in the art for an improved steam box design which provides for increased condensation of steam in the web and improved dewatering.

SUMMARY OF THE DISCLOSURE

To overcome the limitations of the prior art the present invention provides a steam box having a curved bottom plate which may be paired with a vacuum dewatering apparatus to partially dewater a fibrous web. More particularly a steam box is provided with a bottom plate facing the web to be dewatered, the plate having a curvilinear portion that provides for improved flow of steam and machine room air. The curvilinear shape provides several advantages, including, decreasing the velocity of the ambient machine room air along the trailing edge boundary, such air velocity is equal to or less than the steam velocity, reducing turbulence inducing dead zones in the steam addition zone and increasing the amount of steam that is delivered to a web along the steam addition zone. These improvements enable the addition of high amounts of steam per pound of fiber and increase vacuum dewatering efficiency without disrupting the web or the overall web manufacturing process. For example, in certain embodiments the steam box is capable of delivering in excess of 0.5 pounds of steam per pound of fiber and in particularly preferred embodiments in excess of 1.0 pounds of steam per pound of fiber, such as from about 1.0 to about 1.5 pounds of steam per pound of fiber.

Accordingly, one advantage of the present invention is that it enables the addition of steam to the fibrous web at velocities that equal or exceed the velocity of machine room air, as measured along the steam box's trailing edge. For example, in certain embodiments steam velocity may be equal to or greater than the velocity of air along the trailing edge, such as about 1.5 times greater, such as from about 1.5 to about 5.0 times and more preferably from about 2.0 to about 3.0 times greater, than the velocity of machine room air. Without being bound by any particular theory, it is believed that by increasing the velocity of steam relative to machine room air the steam may more uniformly be applied to the web and therefore transfer energy to the water within the web more uniformly as it cools and condenses on the web surface.

Another advantage of the present invention is that the curved bottom plate reduces machine room air turbulence as it is drawn along the plate towards the vacuum dewatering surface in the vacuum zone. Reducing machine room air turbulence in the vacuum zone further improves the uniformity with which steam contacts the web and enables the steam to transfer more energy to the web to facilitate dewatering.

Yet another benefit of the instant invention is that it permits the vacuum apparatus to pull air from the machine room with less turbulence and at lower velocity with fewer eddies which minimizes the amount of air pulled from beneath the web and prevents damage to the web.

Still another benefit of increasing steam velocity relative to air velocity is that it may improve the amount of steam that is captured by the vacuum dewatering apparatus and reduces the amount of steam that is expelled to the machine room.

Thus, in one aspect the present invention provides a vacuum dewatering apparatus comprising a vacuum box having an apertured cover disposed opposite of a steam box, the steam box comprising a bottom plate having a substantially flat portion and a curvilinear portion, at least a portion of the curvilinear portion comprising a plurality of apertures, wherein at least a portion of the apertures are disposed on the bottom plate opposite at least a portion of the apertures disposed on the vacuum dewatering apparatus cover.

In another aspect the present invention provides a steam box comprising a steam housing in sealed communication with a steam inlet, the steam housing a having an apertured bottom plate, the cross-sectional shape of the apertured bottom plate having a curvilinear portion and a linear portion.

In still another aspect the present invention provides a vacuum dewatering apparatus comprising a steam box comprising a steam housing in sealed communication with a steam inlet; the steam housing having an apertured bottom plate, the cross-sectional shape of the apertured bottom plate having a curvilinear portion and a linear portion; a vacuum box having an apertured cover in facing arrangement with the apertured bottom plate; a belt for continuously conveying a fibrous web between the apertured bottom plate and the plurality of vacuum slots.

In yet another aspect the present invention provides a vacuum dewatering apparatus comprising a steam box comprising a steam housing in sealed communication with a steam inlet; the steam housing a having an apertured bottom plate, the cross-sectional shape of the apertured bottom plate having a linear portion with plurality of apertures disposed thereon to define a first steam addition zone and a curvilinear portion with a plurality of apertures disposed thereon to define a second steam addition zone; a vacuum box having an apertured cover in facing arrangement with the second steam addition zone; a belt for continuously conveying a fibrous web between the apertured bottom plate and the plurality of vacuum slots.

DETAILED DESCRIPTION OF THE DISCLOSURE

Figure 1A:
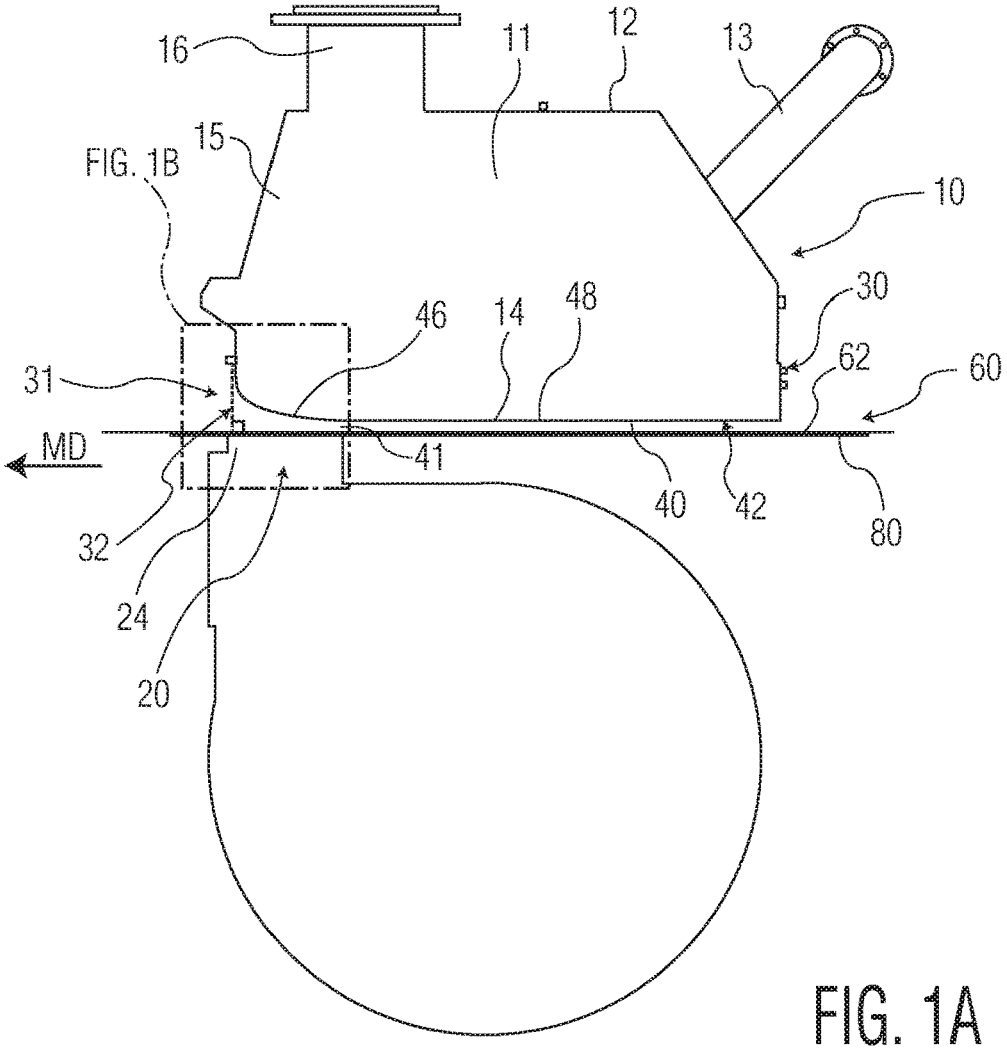
FIG. 1A is a schematic view of a dewatering apparatus according to one embodiment of the present invention.

As is common in the art, the instant vacuum dewatering apparatus comprises a steam box which impinges steam onto a fibrous web, and more particularly a wet fibrous web comprising wood pulp fibers and water, supported on a travelling papermaking belt. The steam heats the water in the web causing its viscosity and surface tension to be reduced. The heated water, with its reduced viscosity and surface tension, may be removed from the web by a vacuum dewatering apparatus. In this manner, in one particular embodiment, the steam box of the present invention may be paired with a vacuum box to partially dewater a fibrous web being conveyed on a papermaking belt.

Generally the steam box of the present invention is useful in the manufacture of fibrous products, and particularly tissue products having basis weights less than about 100 grams per square meter (gsm) and more preferably less than about 70 gsm, such as from about 10 to about 100 gsm and more preferably from about 15 to about 70 gsm. Typically tissue products are manufactured by wet forming a fibrous web and then partially dewatering the web using the modified steam box of the present invention. The modified steam box of the invention is generally used where it is advantageous to apply steam to a fibrous web traveling continuously through a process involving dewatering such as, for example, in forming, pressing, or otherwise treating a fibrous web.

The steam box is generally arranged such that the apertured bottom plate faces the moving fibrous web, which is supported by a belt and conveyed over a vacuum dewatering apparatus opposite the bottom plate of the steam box. In this manner steam generated by the steam box is transported through the apertures disposed along the bottom plate and onto the web where it heats water in the web which is subsequently removed by the vacuum dewatering apparatus. Thus the apertures may be said to define a steam addition zone, i.e., a region of the bottom plate in which steam is added to the fibrous web by the steam box.

The steam box of the present invention has a curvilinear apertured bottom plate extending across a portion of the web's width for delivering steam adjacent to the web. The bottom plate's curvilinear shape reduces the turbulence in the dewatering zone and surprisingly enables delivery of higher volumes of steam to the wet fibrous web, improving vacuum dewatering efficiency without disrupting the web or the overall web manufacturing process. For example, in certain embodiments the steam box is capable of delivering in excess of 0.5 pounds of steam per pound of fiber and in particularly preferred embodiments in excess of 1.0 pounds of steam per pound of fiber, such as from about 1.0 to about 1.5 pounds of steam per pound of fiber.

The bottom plate's curvilinear shape also reduces the turbulence of machine room air being pulled into the vacuum dewatering zone by the vacuum apparatus enabling the use of higher degrees of vacuum, such as greater than about 18 inches Hg and in particularly preferred embodiments greater than about 20 inches Hg, such as from about 20 to about 25 inches Hg. As a result, the consistency of the fibrous web after the vacuum dewatering zone may be greater than about 25 percent, and more preferably greater than about 30 percent and still more preferably greater than about 35 percent, such as from about 25 to about 38 percent. For dryer limited operations the improved dewatering increases productivity. Further, product quality, in terms of the uniformity, may also be improved and energy consumption reduced.

Figure 1B:
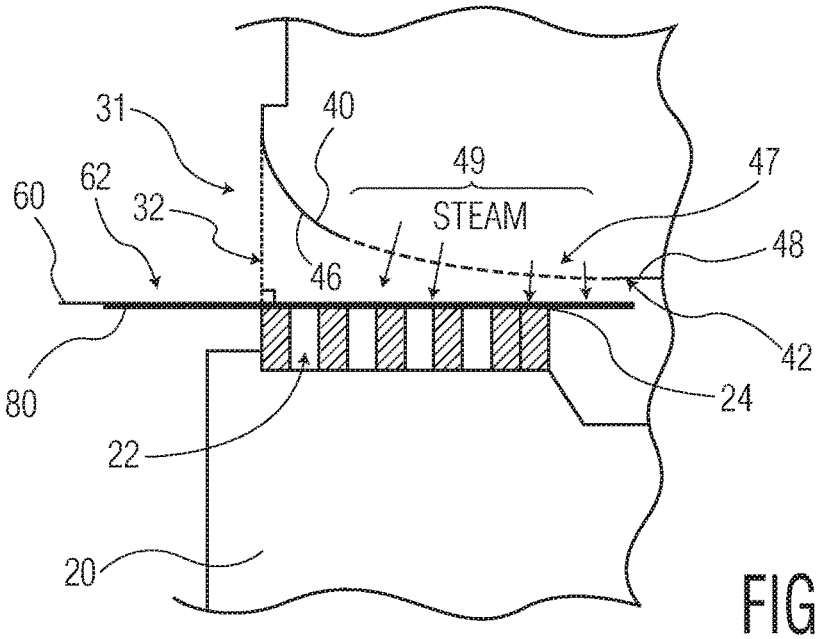
FIG. 1B is a detailed cross-sectional view of a portion of FIG. 1A.

With reference to FIG. 1, the steam box 10 comprises a hood 15, which is shown as being a box-like structure having enclosing sidewalls 11 and a top 12, a stem inlet 16 and optionally a steam control 13. The steam box 10 may be suspended just above the upper surface 62 of a fibrous web 60 such that the plate 40 faces the upper surface 62 of the web 60. The web 60 is supported by a belt 80 moving the web 60 in the machine direction (MD). The belt 80 slides across an apertured cover 24 of the vacuum box 20 which opposes a portion of the bottom plate 40 and pulls water from web 60 as it is transported across its upper surface. The apertured vacuum cover 24 extends substantially perpendicular to and across the width of the web 60.

The steam housing is preferably separated into a plurality of steam discharge chambers or compartments along its length. By regulating the amount of steam that passes through each compartment, it is possible to control the level of condensate that is applied along the cross-machine direction of the moving web. For example, the amount of steam that enters into the individual chambers can be controlled in response to variations in measured properties of the web along its cross-machine direction (CD). Furthermore, the perimeter(s) of one or more of the compartments that define that steam profiling zone for the steam application can also be modified. This permits control of the steam profile along the cross-machine direction as well. The invention is illustrated in an apparatus with multiple steam discharge chambers or compartments. The partitions or baffle panels that are laterally spaced apart create corresponding profiling zones that are covered by an apertured bottom plate through which steam passes. It is understood however that the invention can be implemented with a steam housing having a single discharge chamber.

For a steam box having an apertured bottom plate of a fixed width, the steam flow rate passing through the steam distributor is determined by several properties of the aperture plate as well as the steam pressure in the steam housing. Thus, in one embodiment, the steam box may comprise a steam distributor capable of delivering controllable steam flow to the web by manipulating the steam pressure in the steam housing. An actuator valve located between the inlet and the steam housing can be used to provide the required steam pressure in the steam housing. The inlet is in sealed communication with a pressurized steam source (not shown) that is generally remote from the paper machine. Increasing the steam pressure inside the housing increases the steam flow passing through the apertured plate and consequently increases the amount of steam received by the moving web.

With further reference to FIG. 1, the bottom surface of the steam box 10 comprises an apertured plate 40 having a bottom surface 42 in facing arrangement with the web's top surface 62. The plate is generally mounted in facing arrangement with a fibrous web traveling along substantially horizontal path that is generally parallel to at least a portion of the plate. Ideally the plate's bottom surface 42 is located as close as practical to the fibrous web 60, supported on travelling belt 80. A clearance of at least about 5 mm, such as from about 5 to about 25 mm and more preferably from about 10 to about 20 mm is typical, as measured between the plate's bottom surface 42 and the web's upper surface 62 along the linear portion 48 of the plate. The hood 15 extends sufficiently in the cross-machine direction of the web 60 to effectively apply steam to the web 60 and in a particularly preferred embodiment across the entire width of the web 60.

While a portion of the plate is parallel to the substantially horizontal path of the web, the plate is not flat, but rather has a curvilinear portion 46 and a linear portion 48. Generally the linear portion 48 is adjacent to the leading edge 30 of the steam box 15, i.e., the portion of the steam box first encountered by the fibrous web as it is transported in the MD, and the curvilinear portion 46 is adjacent to the trailing edge 31 of the steam box 15, i.e., the last portion of the steam box encountered by the fibrous web as it is transported in the MD. Generally the trailing edge 31 of the steam box 15 lies along a tangent line 32 which is substantially perpendicular to the belt 80.

A portion of the apertured bottom plate 40 is generally opposed by a vacuum apparatus, such as a vacuum box 20, which are well known in the art. In certain embodiments the vacuum box is coextensive with the steam box in the cross-machine direction (CD). The steam box and vacuum box may be positioned anywhere throughout the papermaking process where the web is supported by a belt and preferably after forming and before the web enters the drying section. In a particularly preferred embodiment the steam box and vacuum box are positioned along the forming section of the papermaking machine just after web formation has been stabilized and the moisture content of the web is about 90 percent by weight.

The vacuum box generally refers to a box-like construction creating a vacuum of approximately greater than about 18 inches Hg and in particularly preferred embodiments greater than about 20 inches Hg, such as from about 20 to about 25 inches Hg, between the vacuum box and the belt/web. The purpose of the vacuum is to remove water from the web after it has been heated by the steam emitted from the steam box. The amount of vacuum imparted to the web is controlled to prevent the belt/web from flapping, for example, due to excessive machine room air being drawn in from below the belt, and thus coming into contact with the steam hood. The aim is to guide the web in a controlled manner through the slot formed between the boxes.

The vacuum dewatering box is preferably provided with a cover, such as a ceramic cover, to resist the abrasive wear caused by the passage of the fabric and product over its surface. The cover comprises a plurality of apertures. In one embodiment the apertures comprise a slot extending in the CD across the width of the cover and across the width of the fabric and has been effective in providing even drainage. The slot sizes may range in linear MD width from 1.0 to about 2.0 cm and preferably the cover comprises a plurality of slots, such as from about 2 to about 6 slots where the total MD width of the slots is from about 2.0 to about 12.0 cm. In other embodiments the slots may have a herringbone, zigzag or intermittent pattern. In still other embodiments the apertures may comprise holes and more preferably linear rows of rectilinear holes that extends the CD.

The steam box bottom plate 40 comprises a plurality of apertures 47 which generally define a steam addition zone 49 for providing steam (illustrated using arrows in the detail view of FIG. 1B) across at least a portion of the web 60 width. Preferably at least a portion of the steam addition zone 49 is disposed along the curvilinear section 46. Without wishing to be bound by any particularly theory, it is believed that by positioning the steam addition zone at least partially along the curvilinear portion the velocity of steam in the area beneath the steam addition zone may equal or exceed that of ambient machine room air. For example, in a particularly preferred embodiment, the steam addition zone is disposed entirely along the curvilinear portion and extends along at least about 80 percent of the curvilinear zone and the steam velocity is equal to or greater than the machine room air velocity as measured along the trailing edge boundary (defined by the tangent line 32). In a particularly preferred embodiment the steam velocity is from about 1.5 to about 5 times greater than the ambient machine room air along the trailing edge boundary, such as from about 2 to about 4 time times greater. By maintaining steam velocities equal to or greater than machine room air velocities, the rate of discharge of steam from the bottom of the hood may be increased to greater than about 1.0 pound of steam per pound of fiber and more preferably greater than about 1.5 pounds of steam per pound of fiber.

In addition to the curvilinear portion 46 the bottom plate also has a linear portion 48. Generally the linear portion 48 is adjacent to the steam box's leading edge 30, which may generally be defined as the edge of the bottom plate 40 under which the web 60 first traverses as it is conveyed in the machine direction. Conversely the curvilinear portion 46 is generally adjacent to the steam box's trailing edge 31, may generally be defined as the edge of the bottom plate 40 opposite of the leading edge 30 and is the final edge of the steam box the web 60 passes as it is conveyed in the machine direction. Like the curvilinear portion, the linear portion may also include apertures. In this manner the linear portion may comprise a plurality of apertures defining a first steam addition zone and the curvilinear portion may comprise a plurality of apertures defining a second steam addition zone. Preferably the first and the second steam addition zones are spaced apart from one another some distance such as at least about 20 cm, and more preferably at least about 25 cm. In a particularly preferred embodiment the first steam addition zone is not opposed by a vacuum apparatus while the second steam addition zone is at least partially opposed by a vacuum apparatus. In this manner the first steam addition zone merely impinges steam onto the surface of the web as it is conveyed below it and the second steam addition zone impinges steam onto the web which is subsequently drawn through the web by the vacuum apparatus.

Figure 3:
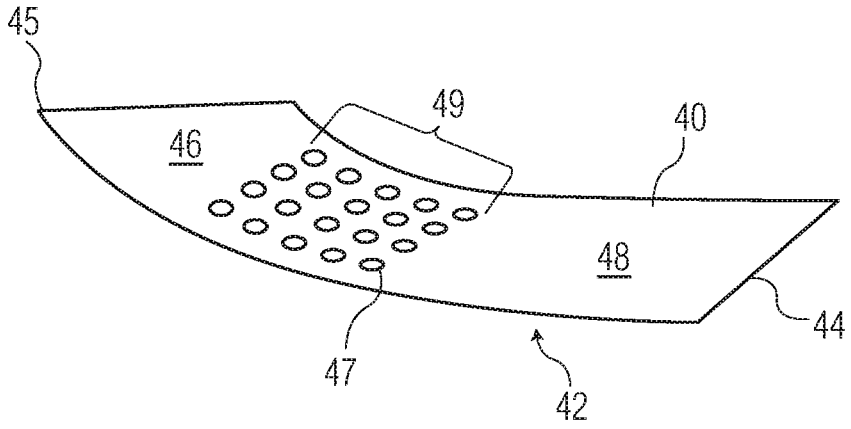
FIG. 3 is a perspective view of an apertured bottom plate for a steam box according to one embodiment of the present invention.

With reference now to FIG. 3, the bottom plate 40 has a curvilinear portion 46 comprising a plurality of apertures 47. The plurality of apertures may consist of multiple holes, slots, or slits. Additionally, the holes, slots, and/or slits, can be continuous, discontinuous, collinear, and/or collectively elongate in the MD, CD, and/or any angle relative to the CD. The total open area of the aperture(s) is preferably selected to provide the required steam flow without disrupting the sheet. The size of the apertures should be sufficiently small to minimize disruption of the web. For example, while the cross-sectional area of the apertures is illustrated as being circular the area can be rectangular or other polygonal shape. In the case where the cross-sectional area is circular, its diameter typically ranges from 1.0 to about 8.0 mm and preferably from 2.0 to about 6.0 mm and still more preferably from about 3.0 to about 5.0 mm. Regardless of the geometry, the cross-sectional area of each aperture typically ranges from about 0.8 to about 50 $mm^2$ and more preferably from 7.0 to about 20 $mm^2$.

The apertures may be arranged along the bottom plate in both the machine and cross-machine directions. In a particularly preferred embodiment the apertures extend along the entire width of the bottom plate in the cross-machine direction and across at least a portion of the bottom plate in the machine direction along the curvilinear portion. In other embodiments the apertures maybe be disposed along the entire length of the curvilinear portion in the MD, such as from the leading edge 44 to its trailing edge 45. In other embodiments the apertures maybe be disposed along only a portion of the curvilinear portion's length in the MD, such as illustrated in FIG. 3. Regardless of whether the apertures extend across the curvilinear portion in its MD or CD, at least about 50 percent of the curvilinear portion's surface area is apertured and more preferably at least about 60 percent, such as from about 50 to about 90 percent and more preferably from about 60 to about 85 percent. In a particularly preferred embodiment the apertures are disposed in a regular, continuous pattern across the curvilinear portion with the apertures being equally spaced from one another.

In another embodiment the linear portion of the bottom plate may also comprise apertures. Generally the linear steam zone is disposed entirely along the linear portion of the bottom plate and does not extend along the curvilinear portion. In this manner the steam addition zone disposed along the curvilinear portion and the steam addition zone disposed along the linear portion are spaced apart from one another some distance. The apertures disposed along the linear portion may be the same as or may be different than those disposed along the curvilinear portion. For example, in one embodiment the apertures disposed along the linear portion are circular and have a diameter from about 4.0 to about 6.0 mm and the apertures disposed along the curvilinear portion are circular and have a diameter from about 3.0 to about 5.0 mm. In this manner two steam addition zones may be provided, the first provided along the linear portion and the second provided along the curvilinear portion, and the relative amount of steam and its velocity may be varied between the two zones. Further, as noted previously, in a particularly preferred embodiment the steam addition zone disposed along the linear portion is generally not opposed to a vacuum apparatus in operation, while the steam addition zone disposed along the curvilinear portion is at least partially opposed to a vacuum apparatus.

Figure 2:
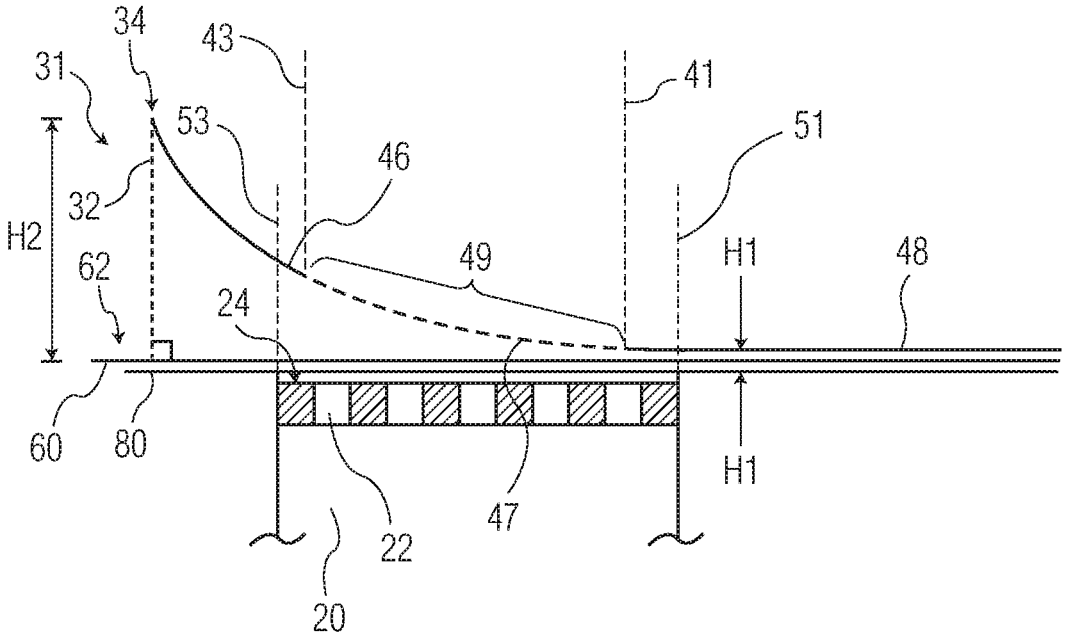
FIG. 2 is a schematic view of steam addition zone according to one embodiment of the present invention.

The relative orientation of the steam addition zone of the curvilinear portion and the vacuum apparatus will now be discussed further with reference to FIG. 2. As illustrated in FIG. 2, the steam box comprises at least one steam addition zone 49 disposed at least partially along the curvilinear portion 46 of the bottom plate 40 (hereinafter referred to as the curved steam addition zone). The curved steam addition zone 49 has a leading edge 41 where steam from the steam hood first contacts the fibrous web 60 as it is conveyed in the machine direction and a trailing edge 43, generally defined by the tangent line 32 lying substantially perpendicular to the belt 80, where steam is finally added to the fibrous web 60 as it departs the curved steam addition zone 49. Similarly the vacuum dewatering apertures 22 are arranged so as to define a leading vacuum edge 51 and a trailing vacuum edge 53.

In certain embodiments the leading vacuum edge 51 may proceed the leading edge 41 of the curved steam addition zone 49 and the trailing edge of the vacuum 53 may be after the trailing edge 43 of the curved steam addition zone 49. While the curved steam addition zone is illustrated as lying entirely within the vacuum dewatering zone, the invention is not so limited. For example, in one embodiment the dewatering slots and steam addition zone may be coextensive with one another. In another embodiment the leading or trailing edge of the steam addition zone may extend beyond the dewatering slots. Additionally, in a particularly preferred embodiment the trailing edge 43 of the steam addition zone 49 is spaced from about 5.0 to about 10 cm, and more preferably from about 7.0 to about 9.0 cm from the trailing edge 53 of the vacuum dewatering zone.

With further reference to FIG. 2, the curvilinear portion 46 is shaped such that the distance (H1) between the fibrous web's upper surface 62 and the plate's bottom surface 42 at the leading edge 51 of the steam addition zone 49 is less than the distance (H2) between the fibrous web's upper surface 62 and the plate's bottom surface 42 at the trailing edge 53 of the steam addition zone 49. Generally H2 is measured along the tangent line 32 between the point 34 and where the line intersects the plate's bottom surface 42 and the fibrous web's upper surface 62. In one embodiment the distance H2 is at least about three times greater than H1, such as from about three to about five times greater. Although the actual height between the bottom surface of the plate and the upper surface of the web may vary depending on manufacturing conditions such as web consistency, web speed and steam addition amounts, in one embodiment H1 is from about 10 to about 30 mm, and more preferably from about 10 to about 15 mm and H2 is from about 30 to about 100 mm, and more preferably from about 50 to about 80 mm.

As noted previously, it is generally preferred that the web travels a substantially horizontal path as it traverses below the steam box and that the variation in height between the web's top surface and the bottom plate is a result of the curved cross-sectional shape of the bottom plate rather than the web traveling along a curved path. The curvilinear portion 46 generally has a cross-sectional shape with a continuously increasing angular relation to the linear portion 48, from its leading edge 44 to its trailing edge 45, A variety of cross-sectional shapes having continuously increasing angles are contemplated. For example the curvilinear portion may be circular, elliptical or parabolic. One skilled in the art will appreciate that the curvilinear portion may comprise a plurality of discrete linear segments arranged so as to have an overall curvilinear shape. Where the curvilinear portion comprises a plurality of discrete linear segments the relative angle of any given segment generally is greater than the preceding segment.

In a particularly preferred embodiment the cross-sectional shape of the curvilinear portion is elliptical and more preferably an ellipse having a major axis that is at least about two times the minor axis, such as from about two to about six times and more preferably from about two to about four times. For example, in one embodiment the elliptically shaped bottom plate may have a major axis from about 100 to about 300 mm, more preferably from about 125 to about 200 mm and still more preferably from about 150 to about 175 mm and a minor axis from about 50 to about 150 mm.

By providing the bottom plate of the steam box with a curvilinear portion and disposing at least a portion of the steam addition zone along the curvilinear portion the present invention increases the uniformity of steam addition to the fibrous web and water removal therefrom. The basic approach requires providing high velocity steam, relative to the velocity of the machine room air, in contact with the travelling fibrous web as it passes over a vacuum dewatering apparatus, such as a vacuum dewatering box. The vacuum box opposite the hood draws the steam into the sheet and extracts a portion of its water load. As the steam contacts the web it condenses giving up its heat of condensation which increases the temperature of the water content of the web, thereby improving the dewatering rate.

Further, while not wishing to be bound by any particular theory, in certain embodiments by providing the bottom plate with a curvilinear portion the velocity of the steam, at a point along the trailing edge of the steam box, may be equal to or greater than the velocity of air being drawn in by the vacuum along the same boundary. In this manner, dead zones in the area between the steam box and vacuum dewatering apertures, referred to herein as the dewatering zone, may be reduced or eliminated. Another benefit of the steam velocity equaling or exceeding the velocity of the ambient machine room air along the trailing edge is that there may be a more even distribution of steam on the web along the dewatering zone.

While various steam boxes and web dewatering apparatuses have been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto and the foregoing embodiments.

In a first embodiment the present invention provides a steam box comprising a steam housing in sealed communication with a steam inlet the steam housing having an apertured bottom plate, the cross-sectional shape of the apertured bottom plate having a curvilinear portion and a linear portion.

In a second embodiment the present invention provides the steam box of the first embodiment wherein the apertured bottom plate has a leading edge and a trailing edge and wherein the curvilinear portion is adjacent to the trailing edge and the linear portion is adjacent to the leading edge.

In a third embodiment the present invention provides the steam box of the first or the second embodiments wherein the curvilinear portion has an elliptical cross-sectional shape with a major axis and a minor axis where the major axis is at least about two times greater than the minor axis.

In a fourth embodiment the present invention provides the steam box of any one of the first through the third embodiments wherein the bottom plate apertures are disposed at least partially along the curvilinear portion.

In a fifth embodiment the present invention provides the steam box of any one of the first through the fourth embodiments wherein the bottom plate apertures are disposed entirely along the curvilinear portion.

In a sixth embodiment the present invention provides the steam box of any one of the first through the fifth embodiments wherein a first plurality of apertures are disposed along the curvilinear portion to define a first steam addition zone and a second plurality of apertures are disposed along the linear portion to define a second steam addition zone and wherein the first and the second steam addition zones are spaced apart from one another.

In a seventh embodiment the present invention provides the steam box of any one of the first through the sixth embodiments wherein apertures have a circular cross-section.

In an eighth embodiment the present invention provides the steam box of any one of the first through the seventh embodiments wherein at least about 60 percent of the surface area of the curvilinear portion is apertured.

What is claimed is:

1. A steam box comprising a steam housing in sealed communication with a steam inlet, the steam housing having an apertured bottom plate having a leading edge and a trailing edge, the cross-sectional shape of the apertured bottom plate having a curvilinear portion and a linear portion wherein the curvilinear portion has an elliptical cross-sectional shape with a major axis and a minor axis where the major axis is at least about two times greater than the minor axis and is adjacent to the trailing edge and the linear portion is adjacent to the leading edge.

2. The steam box of claim 1 wherein the bottom plate apertures are disposed at least partially along the curvilinear portion.

3. The steam box of claim 1 wherein the bottom plate apertures are disposed entirely along the curvilinear portion.

4. A steam box comprising a steam housing in sealed communication with a steam inlet the steam housing having a bottom plate having a leading edge and a trailing edge and a cross-sectional shape comprising a curvilinear portion and a linear portion, wherein the curvilinear portion is adjacent to the trailing edge and the linear portion is adjacent to the leading edge, a plurality of apertures disposed on the linear portion and defining a first steam addition zone and a plurality of apertures disposed on the curvilinear portion and defining a second steam addition zone, wherein the first and second steam addition zones are spaced apart from one another.

5. The steam box of claim 4 wherein the curvilinear portion has an elliptical cross-sectional shape with a major axis and a minor axis where the major axis is at least about two times greater than the minor axis.

6. The steam box of claim 4 wherein the apertures have a circular cross-section.

7. The steam box of claim 4 wherein the apertures defining the first steam addition zone are circular and have a diameter from 3 to 5 mm and the apertures defining the second steam addition zone are circular and have a diameter from 4 to 6 mm.

8. The steam box of claim 4 wherein at least about 60 percent of the surface area of the curvilinear portion is apertured.

9. A dewatering apparatus comprising:

a. a steam box comprising a steam housing in sealed communication with a steam inlet, the steam housing having an apertured bottom plate having a leading edge and a trailing edge and a cross-sectional shape comprising a curvilinear portion and a linear portion, wherein the curvilinear portion is adjacent to the trailing edge and the linear portion is adjacent to the leading edge and wherein the leading edge is unobstructed and wherein the curvilinear portion has an elliptical cross-sectional shape with a major axis and a minor axis where the major axis is at least about two times greater than the minor axis;

b. a vacuum box comprising a cover having a plurality of apertures in facing arrangement with the apertured bottom plate;

c. a belt for continuously conveying a fibrous web between the apertured bottom plate and the plurality of vacuum apertures.

10. The dewatering apparatus of claim 9 wherein the bottom plate comprises a plurality of apertures defining a steam addition zone having a leading edge and a trailing edge, and the plurality of vacuum cover apertures define a vacuum dewatering zone having a leading edge and a trailing edge, and wherein the leading edge of the vacuum dewatering zone precedes the leading edge of the steam addition zone.

11. The dewatering apparatus of claim 9 wherein the bottom plate comprises a plurality of apertures defining a steam addition zone having a leading edge and a trailing edge, the plurality of vacuum cover apertures define a vacuum dewatering zone having a leading edge and a trailing edge, and wherein the steam addition zone and the vacuum dewatering zones are coextensive with one another.

12. The dewatering apparatus of claim 9 wherein the bottom plate comprises a plurality of apertures defining a steam addition zone having a leading edge and a trailing edge, the plurality of vacuum cover apertures define a vacuum dewatering zone having a leading edge and a trailing edge, and wherein the trailing edge of the vacuum dewatering zone precedes the trailing edge of the steam addition zone.

13. The dewatering apparatus of claim 9 wherein the curvilinear portion is convex and the bottom plate apertures are disposed at least partially along the curvilinear portion.

14. The dewatering apparatus of claim 9 wherein a first plurality of apertures are disposed along the linear portion to define a first steam addition zone and a second plurality of apertures are disposed along the curvilinear portion to define a second steam addition zone.

15. The dewatering apparatus of claim 14 wherein the vacuum box opposes the second steam addition zone.

16. The dewatering apparatus of claim 14 wherein the first steam addition zone is not opposed by a vacuum box.

* * * * *